US007673765B2

(12) United States Patent
Pritchett, Jr.

(10) Patent No.: US 7,673,765 B2
(45) Date of Patent: Mar. 9, 2010

(54) HOT FILL CONTAINER HAVING IMPROVED VACUUM PANEL CONFIGURATION

(75) Inventor: Raymond A. Pritchett, Jr., Brogue, PA (US)

(73) Assignee: Graham Packaging Company, L.P., York, PA (US)

( * ) Notice: Subject to any disclaimer, the term of this patent is extended or adjusted under 35 U.S.C. 154(b) by 0 days.

(21) Appl. No.: 12/128,120

(22) Filed: May 28, 2008

(65) Prior Publication Data

US 2009/0294399 A1 Dec. 3, 2009

(51) Int. Cl.
*B65D 1/46* (2006.01)
*B65D 23/08* (2006.01)

(52) U.S. Cl. ..... 215/381; 215/382; 220/671; 220/675

(58) Field of Classification Search ..... 215/381–383; 220/669, 671, 675
See application file for complete search history.

(56) References Cited

U.S. PATENT DOCUMENTS

| | | | | | |
|---|---|---|---|---|---|
| D201,400 | S * | 6/1965 | Kneeland | D9/774 |
| 3,325,031 | A * | 6/1967 | Singier | 215/247 |
| 4,749,092 | A * | 6/1988 | Sugiura et al. | 215/381 |
| D384,586 | S * | 10/1997 | Peek | D9/520 |
| 5,690,244 | A * | 11/1997 | Darr | 215/382 |
| 5,704,504 | A * | 1/1998 | Bueno | 215/381 |
| 5,762,221 | A * | 6/1998 | Tobias et al. | 215/381 |
| D468,213 | S * | 1/2003 | Moore et al. | D9/549 |
| 6,763,969 | B1 * | 7/2004 | Melrose et al. | 220/669 |
| 6,929,138 | B2 | 8/2005 | Melrose et al. | |
| 7,073,675 | B2 * | 7/2006 | Trude | 215/381 |
| D529,389 | S * | 10/2006 | Trude | D9/538 |
| 2001/0035392 | A1 * | 11/2001 | Ota et al. | 215/381 |
| 2002/0000421 | A1 * | 1/2002 | Ota et al. | 215/381 |
| 2003/0015491 | A1 * | 1/2003 | Melrose et al. | 215/381 |
| 2003/0161980 | A1 | 8/2003 | Nelson | |
| 2004/0129598 | A1 * | 7/2004 | Zhang et al. | 206/524.8 |
| 2004/0159627 | A1 | 8/2004 | Trude | |
| 2006/0131258 | A1 | 6/2006 | Yourist | |
| 2007/0039917 | A1 * | 2/2007 | Yourist | 215/379 |

FOREIGN PATENT DOCUMENTS

| | | |
|---|---|---|
| EP | 1889788 A1 | 2/2008 |
| EP | 1897676 A1 | 3/2008 |
| JP | 10258822 | 9/1998 |

* cited by examiner

*Primary Examiner*—Sue A. Weaver
(74) *Attorney, Agent, or Firm*—Knoble Yoshida & Dunleavy, LLC

(57) ABSTRACT

A hot fill container of the type that is used package fruit juices and other beverages includes a vacuum panel configuration that provides optimal volumetric efficiency, material usage and container strength and is particularly suited for use with smaller containers. The vacuum panel configuration includes a plurality of cageless vacuum panels that are separated by longitudinally extending outwardly projecting creases that are defined in a sidewall of the container. This arrangement maximizes the effective surface area of the vacuum panels relative to the external surface area of the container. Each of the longitudinally extending outwardly projecting creases has a curved outer surface that is convex when viewed in longitudinal cross-section. The cageless vacuum panels are constructed and arranged to be convexly curved when a pressure within the container is equal to an external pressure, but become concavely curved when a predetermined partial vacuum condition exists within said container.

19 Claims, 5 Drawing Sheets

HOT FILL CONTAINER HAVING IMPROVED VACUUM PANEL CONFIGURATION

BACKGROUND OF THE INVENTION

1. Field of the Invention

This invention relates generally to the field of packaging, and more specifically to the field of hot fill type containers.

2. Description of the Related Technology

Hot fill containers are designed to be used with the conventional hot fill process, in which a liquid product such as fruit juice is introduced into the container while warm or hot, as appropriate, for sanitary packaging of the product.

After filling, such containers undergo significant volumetric shrinkage as a result of the cooling of the product within the sealed container. Hot fill type containers accordingly must be designed to have the capability of accommodating such shrinkage. Typically this has been done by incorporating one or more concave vacuum panels into the side wall of the container that are designed to flex inwardly as the volume of the product within the container decreases as a result of cooling.

Conventional vacuum panels are ordinarily framed or caged within the sidewall of the container by the presence of inwardly extending panel portions that are located near the periphery of the vacuum panel. Most of the volumetric contraction capability of the vacuum panel is accomplished by flexure of an interior portion of the vacuum panel that is framed or caged by the inwardly extending panel portions. Unfortunately, the contraction capability of vacuum panels in smaller containers has been limited to less than what is desired in many cases because the maximum surface area of the interior portions of the vacuum panels is limited by framing of the vacuum panel.

Hot fill containers must be designed to be strong enough in the areas outside of the vacuum panel regions so that the deformation that occurs as a result of the volumetric shrinkage of a product within the container is substantially limited to the portions of the container that are designed specifically to accommodate such shrinkage. In addition, since filled containers are often stacked on top of one another for transportation and distribution, the sidewall of such containers must be designed to have sufficient column strength in order to endure a predetermined minimum vertical load. It is important that such column strength not be degraded as the shape of the container changes as result of volumetric shrinkage within the container. To that end, conventional designs for hot fill containers typically included a plurality of vertically extending non-recessed sidewall portions serving as posts between the vacuum panel areas in order to impart additional column strength.

Most hot fill type containers are fabricated from polyethylene terephthalate, which is otherwise known as PET. PET possesses excellent characteristics for such containers, but PET resin is relatively expensive. Accordingly, a PET container design that reduces the amount of material that is used without sacrificing performance will provide a significant competitive advantage within the packaging industry. The presence of numerous surface features such as deeply recessed vacuum panels requiring extensive framing on conventional container designs has inhibited lightweighting of the container to some extent.

A need has existed for an improved hot fill container design provides optimal volumetric efficiency, material usage and container strength and that is particularly suited for use with smaller containers.

SUMMARY OF THE INVENTION

Accordingly, it is an object of the invention to provide an improved hot fill container design provides optimal volumetric efficiency, material usage and container strength and that is particularly suited for use with smaller containers.

In order to achieve the above and other objects of the invention, a hot fill container according to a first aspect of the invention includes a sidewall having an outer surface, the sidewall defining a plurality of cageless vacuum panels, and wherein at least one of the cageless vacuum panels is separated from an adjacent cageless vacuum panel by a longitudinally extending outwardly projecting crease that is defined in the sidewall, and wherein an outer surface of the longitudinally extending outwardly projecting crease as viewed in longitudinal cross-section is convexly curved.

According to a second aspect of the invention, a hot fill container includes a finish portion; a bottom portion, the bottom portion including a heel portion having an outer surface that is substantially circular in horizontal cross-section; and a main body portion, the main body portion having a sidewall with an outer surface, for sidewall defining a plurality of cageless vacuum panels, with at least one of the cageless vacuum panels being separated from an adjacent cageless vacuum panel by a longitudinally extending outwardly projecting crease that is defined in the sidewall, and wherein a lower end of the cageless vacuum panel is smoothly transitioned into said heel portion.

A hot fill container according to a third aspect of the invention includes a sidewall having an outer surface, the sidewall defining a plurality of cageless vacuum panels, and wherein at least one of the cageless vacuum panels is separated from an adjacent cageless vacuum panel by a longitudinally extending outwardly projecting crease that is defined in the sidewall, and wherein an outer surface of the cageless vacuum panel is convexly curved when a pressure within the container is equal to an external pressure, and wherein at least a portion of the outer surface of the cageless vacuum panel is constructed and arranged to become concavely curved when a predetermined partial vacuum condition exists within the container.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
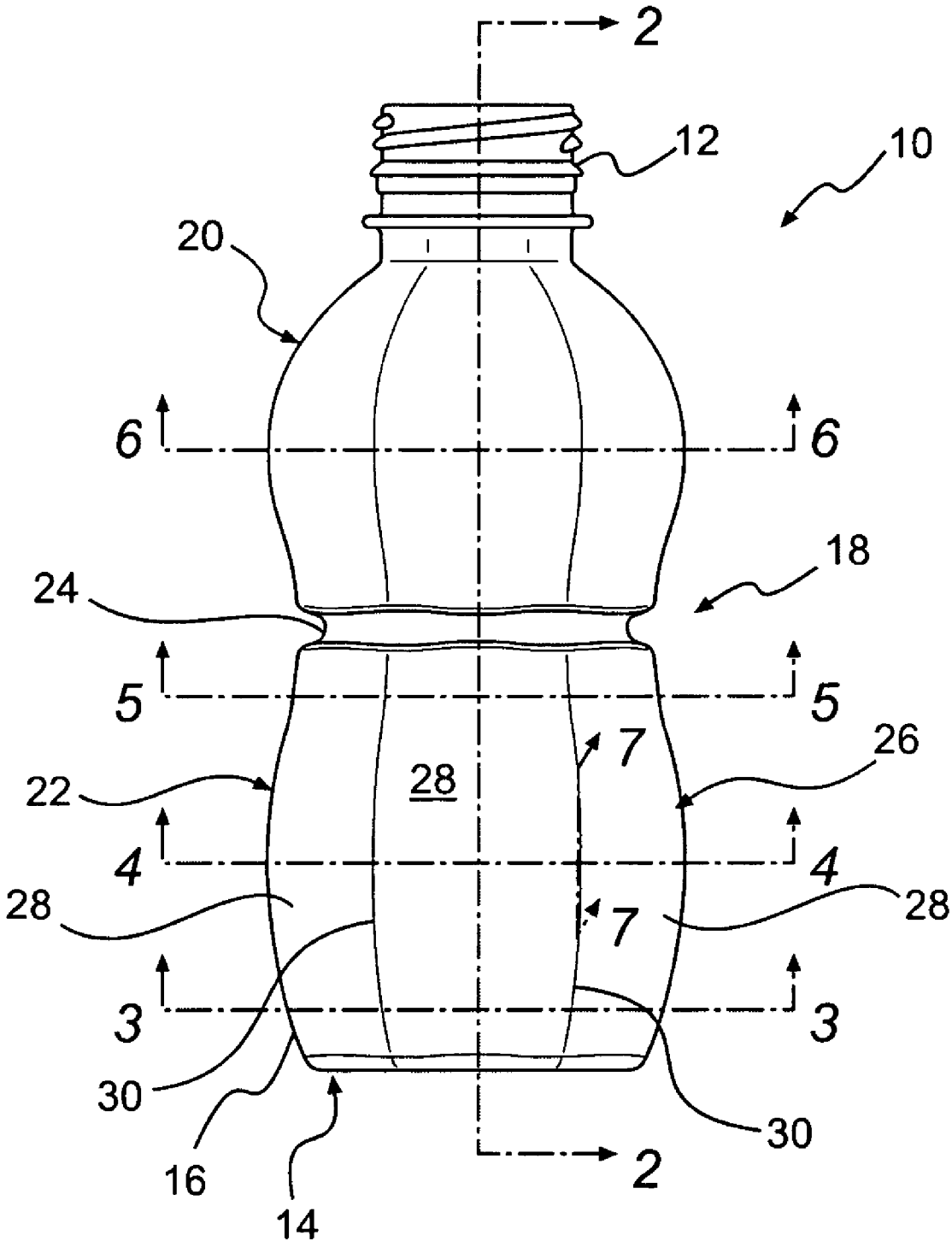
FIG. 1 is a side elevational view of a hot fill container that is constructed according to a referred embodiment of the invention.
Figure 3:
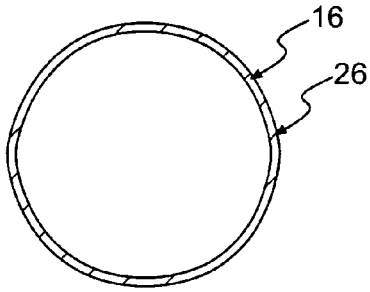
FIG. 3 is a horizontal transverse cross-sectional view taken along lines 3-3 in FIG. 1.

Referring now to the drawings, wherein like reference numerals designate corresponding structure throughout the views, and referring in particular to FIG. 1, a hot fill container 10 that is constructed according to a preferred embodiment of the invention includes a finish portion 12 that is conventionally threaded and a bottom portion 14 that contains a conventional push-up area. Bottom portion 14 further includes a transitional heel portion 16 that includes a portion that is substantially circular in horizontal cross-section, as is best shown in FIG. 3.

Hot fill container 10 further includes a main body portion 18 that is divided into an upper bell portion 20 and a lower portion 22 by means of a narrowed waist 24, as shown in FIG. 1. According to one advantageous feature of the invention, the lower portion 22 of the hot fill container 10 includes a sidewall 26 that is shaped so as to define a vacuum panel configuration that includes a plurality of cageless vacuum panels 28 that are separated by longitudinally extending outwardly projecting creases 30 that are defined in the sidewall 26. This arrangement maximizes the effective surface area of the cageless vacuum panels 28 relative to the external surface area of the container 10.

A cageless vacuum panel for purposes of this document is defined as a vacuum panel that is not characterized by a recessed vacuum panel portion that is caged or framed by discrete, molded inwardly extending sidewall portions. As is clearly shown in FIGS. 1, 4 and 5, the cageless vacuum panels 28 in the preferred embodiment of the invention to not include any such discrete, molded inwardly extending sidewall portion; they are formed continuously with the creases 30 with no inward folds or discontinuities as molded.

Figure 7:
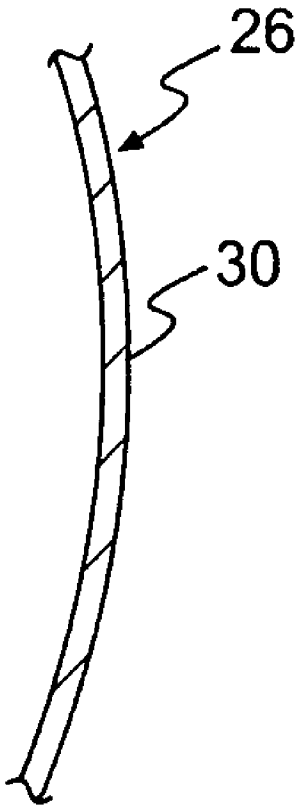
FIG. 7 is a longitudinal cross-sectional view taken along lines 7-7 in FIG. 1.

The creases 30 are preferably oriented longitudinally so as to be substantially parallel to a longitudinal axis of the container 10 when viewed in side elevation in alignment with the longitudinal axis of the container 10. The outer surface of each of the creases 30 is preferably convexly curved when viewed in longitudinal cross-section in the as-molded state, as FIG. 7 shows, and it preferably remains convexly curved when the cageless vacuum panels 28 flex inwardly as a result of an underpressure or partial vacuum condition within the hot fill container 10.

Figure 4:
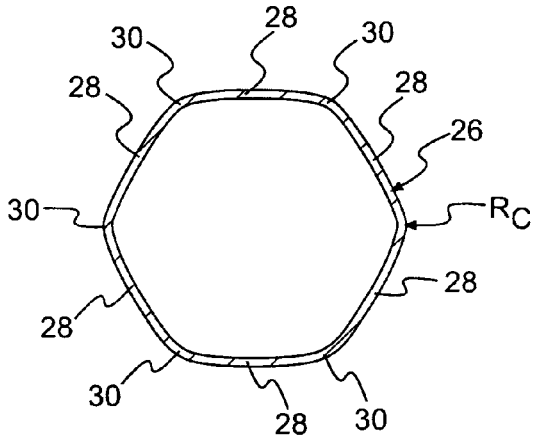
FIG. 4 is a horizontal transverse cross-sectional view taken along lines 4-4 in FIG. 1.
Figure 5:
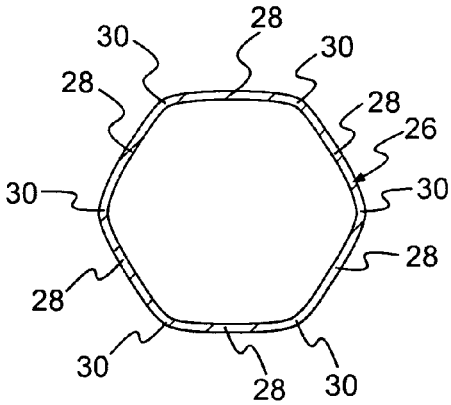
FIG. 5 is a horizontal transverse cross-sectional view taken along lines 5-5 in FIG. 1.
Figure 6:
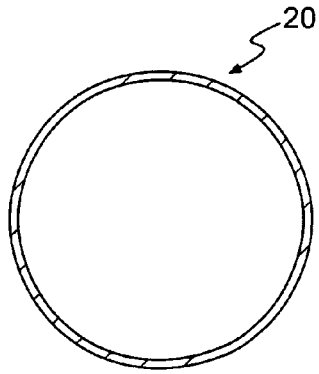
FIG. 6 is a horizontal transverse cross-sectional view taken along lines 6-6 in FIG. 1.

When viewed in horizontal, transverse cross-section as shown in FIGS. 4 and 5, the outer surface of each of the creases 30 in the as molded condition is convexly curved, with an outer radius $R_C$ that is preferably within a range of about 0.1 inches to about 0.5 inches. The creases 30 are formed distinctly and discretely so as to have minimal width, whereby the surface area of the cageless vacuum panels 28 about the periphery of the lower portion 22 of the hot fill container 10 is maximized. The creases 30 are distinguished from larger, flatter posts that have been provided on conventional hot fill containers having conventional vacuum panels in that their external width is minimized, with their entire outer surface as viewed in horizontal transverse cross-section being curved in the relatively small radius of curvature $R_C$. In other words, they have the appearance of creases and not of ordinary areas of sidewall that are simply located between vacuum panels.

The cageless vacuum panels 28 are preferably arranged continuously about the outer periphery of the lower portion 22 of the hot fill container 10 as shown in FIG. 1 so that each cageless vacuum panel 28 is respectively separated from two adjacent cageless vacuum panels 28 by a pair of creases 30. Preferably, the total number of creases 30 corresponds to the total number of cageless vacuum panels 28, and there are at least four cageless vacuum panels 28. More preferably, there are at least five cageless vacuum panels 28 and creases 30. Most preferably, there are at least six cageless vacuum panels 28 and creases 30.

Figure 2:
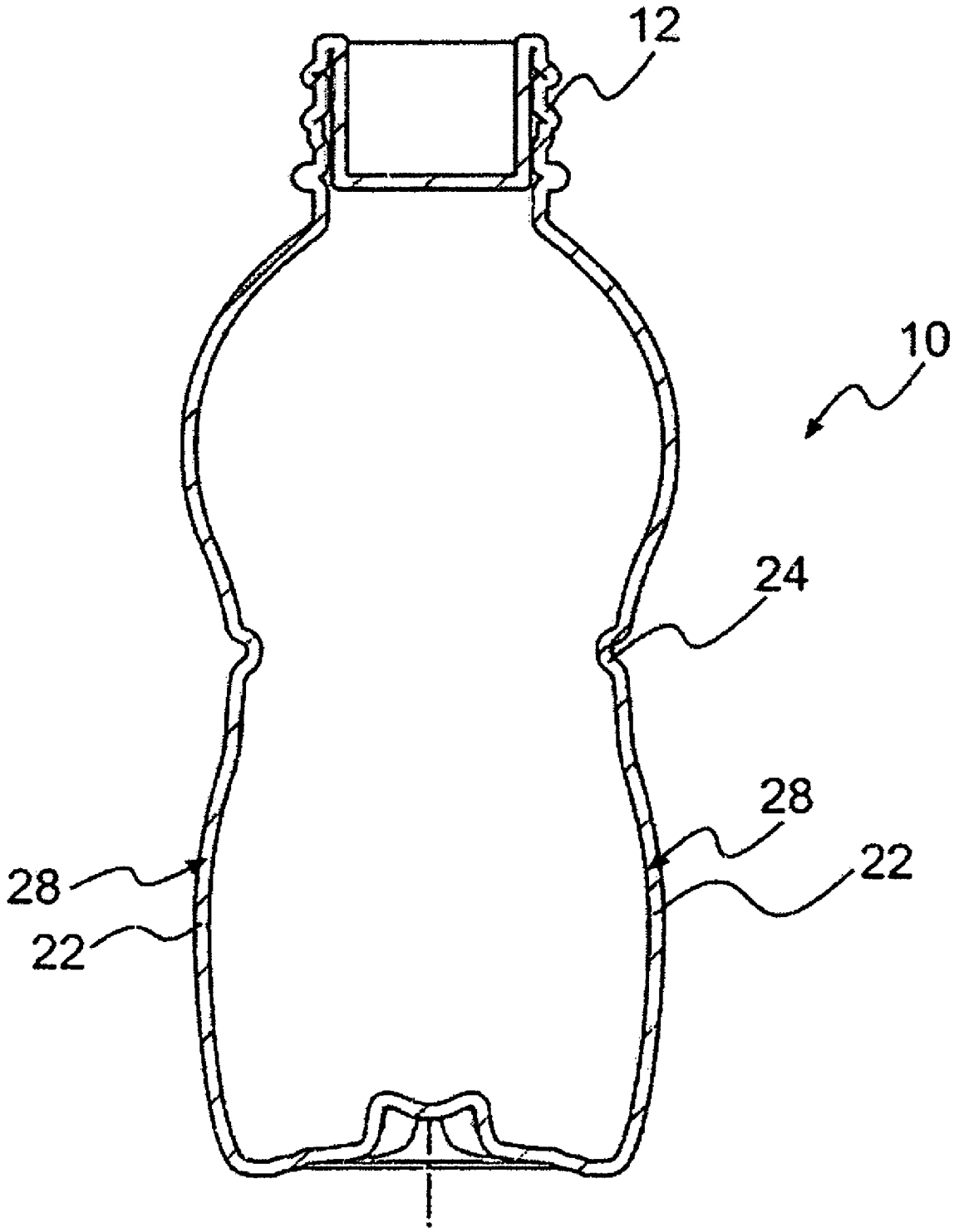
FIG. 2 is a longitudinal cross-sectional view taken along lines 2-2 in FIG. 1.
Figure 8:
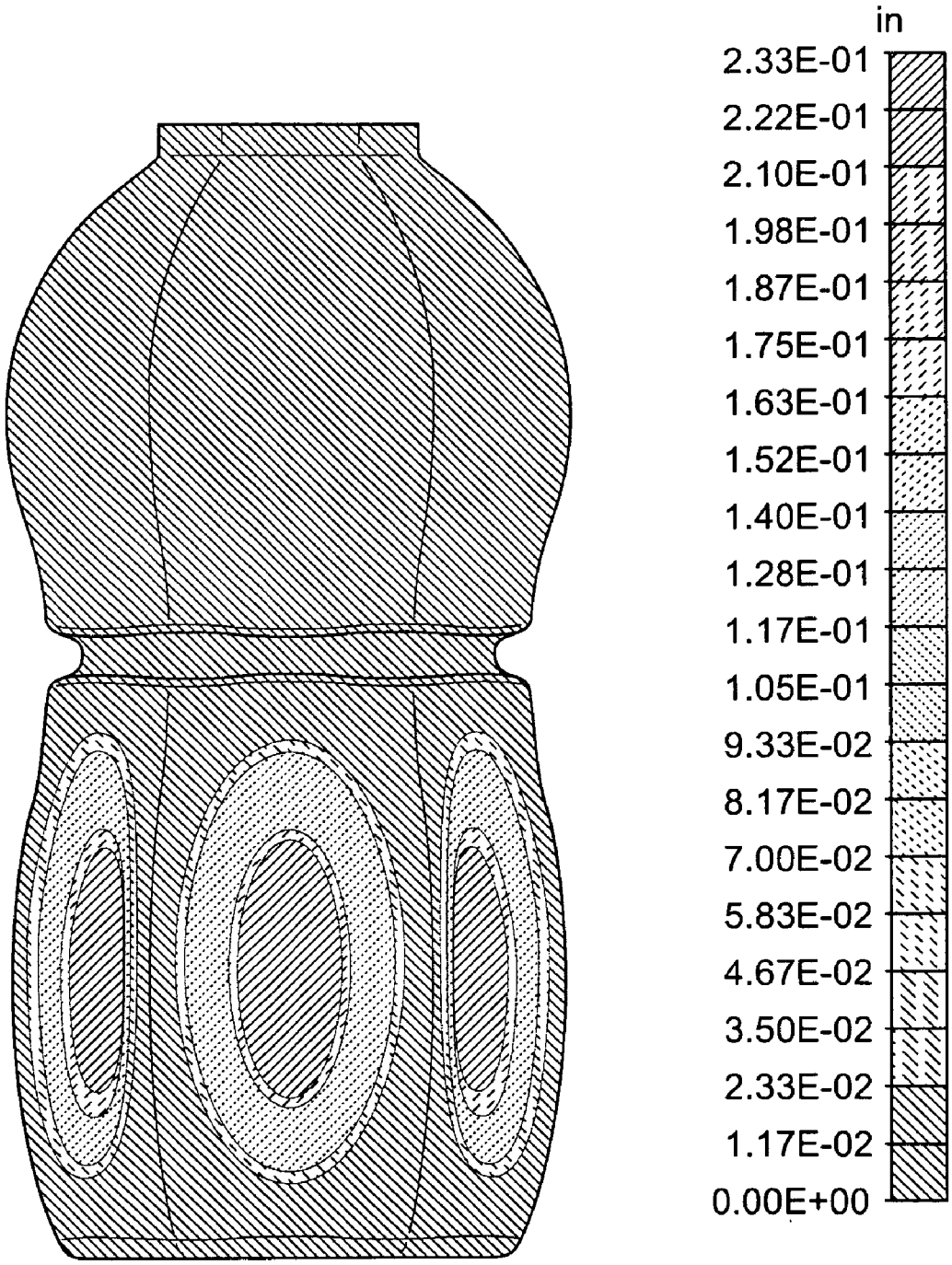
FIG. 8 is a representation of a finite element analysis showing a container according to the preferred embodiment under vacuum conditions.

Each of the cageless vacuum panels 28 has an outer surface that is preferably convex in the as molded state when viewed in longitudinal cross-section, as is best illustrated in FIG. 2. In addition, the outer surface of each of the cageless vacuum panels 28 when viewed in horizontal, transverse cross-section is preferably convex in the as molded state, as is shown in FIGS. 4 and 5. However, when an underpressure or partial vacuum condition of a predetermined magnitude exists within the hot fill container 10, a central portion of each of the cageless vacuum panels 28 is constructed and arranged to invert so as to accommodate volumetric shrinkage that occurs within the hot fill container 10. In the inverted state, the outer surface of a portion of each of the cageless vacuum panels 28 when viewed in horizontal, transverse cross-section will be concave. In addition, while in the inverted state the outer surface of that portion of each of the cageless vacuum panels 28 will also assume a concave shape when viewed in longitudinal cross-section. FIG. 8 is a representation of a finite element analysis showing a container according to the preferred embodiment under vacuum conditions.

In the preferred embodiment each of the cageless vacuum panels 28 has a height that is greater than its width, and therefore when in the inverted state the inversion of the central portions of the respective vacuum panels 28 will cause the hot fill container 10 to assume a fluted appearance. In the inverted state, each of the creases 30 retains its convex shape as viewed in both the longitudinal and transverse planes. However, the radius of curvature $R_C$ of the outer surface of each of the creases 30 may decrease to some extent when the central portions of the cageless vacuum panels 28 assume the inverted shape. This causes a stiffening effect that enhances the strength of the lower portion 22 of the container 10. In particular, the column or top load resistance of the container 10 may be enhanced.

Each of the cageless vacuum panels 28 is also preferably constructed so that a lower portion thereof is smoothly transitioned into the heel portion 16 of the container 10. As a result, the strength of the bottom portion 14 of the container 10 is maintained while maximizing the effective surface area of the cageless vacuum panels 28.

The hot fill container 10 according to the preferred embodiment of the invention may be used to package fruit juices and other beverages using the conventional hot fill process. The vacuum panel configuration including the plurality of cageless vacuum panels 28 and creases 30 will provide optimal volumetric efficiency, material usage and container strength and is particularly suited for use with smaller containers.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A hot fill container, comprising:

a sidewall having an outer surface, said sidewall defining a plurality of cageless vacuum panels, and wherein at least one of said cageless vacuum panels is separated from an adjacent cageless vacuum panel by a longitudinally extending outwardly projecting crease that is defined in said sidewall, and wherein an outer surface of said longitudinally extending outwardly projecting crease as viewed in longitudinal cross-section is continuously convexly curved.

2. A hot fill container according to claim 1, wherein an outer surface of said cageless vacuum panel is convexly curved when a pressure within said container is equal to an external pressure, and wherein at least a portion of said outer surface of said cageless vacuum panel is constructed and arranged to become concavely curved when a predetermined partial vacuum condition exists within said container.

3. A hot fill container according to claim 1, wherein said plurality of said cageless vacuum panels are spaced about an outer periphery of said container and wherein each of said cageless vacuum panels is separated from two adjacent cageless vacuum panels by a corresponding pair of longitudinally extending outwardly projecting creases.

4. A hot fill container according to claim 3, wherein said plurality of said cageless vacuum panels comprises at least four of said cageless vacuum panels.

5. A hot fill container according to claim 4, wherein said plurality of said cageless vacuum panels comprises at least five of said cageless vacuum panels.

6. A hot fill container according to claim 5, wherein said plurality of said cageless vacuum panels comprises six of said cageless vacuum panels.

7. A hot fill container according to claim 1, wherein said container comprises a bottom portion, said bottom portion including a heel portion having an outer surface that is substantially circular in horizontal cross-section, and wherein a lower end of said cageless vacuum panel is smoothly transitioned into said heel portion.

8. A hot fill container, comprising:

a finish portion;

a bottom portion, said bottom portion including a heel portion having an outer surface that is substantially circular in horizontal cross-section; and a main body portion, said main body portion having a sidewall with an outer surface, said sidewall defining a plurality of cageless vacuum panels, with at least one of said cageless vacuum panels being separated from an adjacent cageless vacuum panel by a longitudinally extending outwardly projecting crease that is defined in said sidewall, wherein an outer surface of said longitudinally extending outwardly projecting crease as viewed in longitudinal cross-section is continuously convexly curved, and wherein a lower end of said cageless vacuum panel is smoothly transitioned into said heel portion.

9. A hot fill container according to claim 8, wherein said main body portion comprises an upper bell portion, a lower portion and a waist portion position between said upper bell portion and said lower portion, and wherein said plurality of cageless vacuum panels are located on said lower portion.

10. A hot fill container according to claim 8, wherein an outer surface of said cageless vacuum panel is convexly curved when a pressure within said container is equal to an external pressure, and wherein at least a portion of said outer surface of said cageless vacuum panel is constructed and arranged to become concavely curved when a predetermined partial vacuum condition exists within said container.

11. A hot fill container according to claim 8, wherein said plurality of said cageless vacuum panels are spaced about an outer periphery of said container and wherein each of said cageless vacuum panels is separated from two adjacent cageless vacuum panels by a corresponding pair of longitudinally extending outwardly projecting creases.

12. A hot fill container according to claim 11, wherein said plurality of said cageless vacuum panels comprises at least four of said cageless vacuum panels.

13. A hot fill container according to claim 12, wherein said plurality of said cageless vacuum panels comprises at least five of said cageless vacuum panels.

14. A hot fill container according to claim 13, wherein said plurality of said cageless vacuum panels comprises six of said cageless vacuum panels.

15. A hot fill container, comprising:

a sidewall having an outer surface, said sidewall defining a plurality of cageless vacuum panels, and wherein at least one of said cageless vacuum panels is separated from an adjacent cageless vacuum panel by a longitudinally extending outwardly projecting crease that is defined in said sidewall; wherein an outer surface of said longitudinally extending outwardly projecting crease as viewed in longitudinal cross-section is continuously convexly curved;

an outer surface of said cageless vacuum panel is convexly curved when a pressure within said container is equal to an external pressure, and wherein at least a portion of said outer surface of said cageless vacuum panel is constructed and arranged to become concavely curved when a predetermined partial vacuum condition exists within said container; and wherein said main body portion comprises an upper bell portion, a lower portion and a waist portion position between said upper bell portion and said lower portion, and wherein said plurality of cageless vacuum panels are located on said lower portion.

16. A hot fill container according to claim 15, wherein said plurality of said cageless vacuum panels are spaced about an outer periphery of said container and wherein each of said cageless vacuum panels is separated from two adjacent cageless vacuum panels by a corresponding pair of longitudinally extending outwardly projecting creases.

17. A hot fill container according to claim 16, wherein said plurality of said cageless vacuum panels comprises at least four of said cageless vacuum panels.

18. A hot fill container according to claim 17, wherein said plurality of said cageless vacuum panels comprises at least five of said cageless vacuum panels.

19. A hot fill container according to claim 18, wherein said plurality of said cageless vacuum panels comprises six of said cageless vacuum panels.

* * * * *